US005090137A

United States Patent [19]

Zagar

[11] Patent Number: 5,090,137

[45] Date of Patent: Feb. 25, 1992

[54] PERIMETER SEAL FOR SPLIT ENCLOSURE DRYING HOODS

[75] Inventor: Steve J. Zagar, Green Bay, Wis.

[73] Assignee: W. R. Grace & Co.-Conn., New York, N.Y.

[21] Appl. No.: 464,795

[22] Filed: Jan. 16, 1990

[51] Int. Cl.[5] ..... F26B 25/00

[52] U.S. Cl. ..... 34/242; 34/92; 49/485; 49/498

[58] Field of Search ..... 34/242, 92, 231; 49/485, 488, 498

[56] References Cited

U.S. PATENT DOCUMENTS

| | | | |
|---|---|---|---|
| 1,723,306 | 8/1927 | Sipe . | |
| 2,523,716 | 11/1946 | Parr | 285/109 |
| 3,047,187 | 7/1962 | Taylor et al. | 34/242 |
| 3,339,931 | 12/1964 | Hundt et al. | 277/34.3 |
| 3,572,224 | 3/1971 | Perry | 94/13 |
| 3,589,070 | 6/1971 | Hansen | 49/488 |
| 3,593,971 | 7/1971 | Blackman | 34/242 |
| 3,751,219 | 8/1973 | Kitchel | 34/242 |
| 4,114,668 | 9/1978 | Hickey | 150/0.5 |
| 4,296,540 | 10/1981 | Potter | 34/242 |
| 4,358,899 | 11/1982 | Murch et al. | 34/242 |
| 4,599,841 | 7/1986 | Haid | 52/403 |
| 4,731,016 | 3/1988 | Dixon | 34/242 |

*Primary Examiner*—Henry A. Bennet
*Assistant Examiner*—Denise L. F. Gromada
*Attorney, Agent, or Firm*—Kevin S. Lemack; William L. Baker

[57] ABSTRACT

A seal for a dryer having split enclosure drying hoods is disclosed. The hoods are retractable with respect to each other at at least one separation joint. A gasket capable of conforming to the contour of the joint is positioned in the joint. Preferably the gasket is of an inflatable type. The portions of the upper and lower hoods which terminate at the separation joint comprise a bellows, which provide a non-linear path for heat conduction and in which the gasket is positioned.

7 Claims, 3 Drawing Sheets

PERIMETER SEAL FOR SPLIT ENCLOSURE DRYING HOODS

BACKGROUND OF THE INVENTION

Gas leakage into or out of drying enclosures presents operational problems as well as health and safety hazards. Drying operations involving noxious gases and/or solvent vapors can leak from inside the enclosure to surrounding work areas. Drying operations carried out under conditions inside the enclosure which are above the upper explosive limit (UEL) require minimum leakage of atmospheric oxygen into the enclosure to avoid fire or explosion hazard. Leakage from the enclosure to the surrounding work area also may present a fire or explosion hazard. Many dryer enclosures are of a split design wherein an upper hood separates from the lower enclosure, providing access to internals for cleaning and maintenance purposes. This point of separation requires a perimeter seal which maintains a gas-tight connection under operating temperatures and pressures.

One conventional hood seal is illustrated in FIG. 1. This arrangement has no provision for expansion movement or reduced conduction heat flow from internal to external surfaces of the enclosure. The gasket material compresses against a flat face with a limited range of compression for movement.

Other prior art seal designs did not allow for expansion and movement of the upper and lower dryer enclosure sections due to thermal expansion. Thus gaps developed under operation conditions which caused leaks at various points around the perimeter seal. Specifically, previous hood and seal designs have been observed to lose seal contact when expansion movements are as little as ⅛ to ¼ inch. Such movement is common in dryer hoods operating at internal temperatures from 200° F. to 600° F. In the case of flotation dryer hoods, movement of the upper hood relative to the lower hood could also be intentionally introduced in aligning the upper and lower flotation nozzles. Previous seal designs offered very little range for adjustment to accommodate movement of this type.

SUMMARY OF THE INVENTION

The problems of the prior art have been overcome by the present invention, which provides a perimeter seal for a drying enclosure that accommodates expansion movements therein while reducing stresses caused by thermal expansion. The dryer seal is maintained with movements of 1 inch or more, which allows design of long continuous dryer hoods operating at temperatures to 600° F. or higher without loss of seal contact. In flotation dryers, alignment of the flotation nozzles can be accomplished without loss of seal contact.

It is therefore an object of the present invention to provide a seal in a dryer enclosure that accommodates movement therein.

It is a further object of the present invention to minimize gas leakage into or out of drying enclosures.

A still further object of the present invention is to provide a seal in a dryer enclosure that reduces stresses caused by thermal expansion.

Another object of the present invention is to maintain a seal in a flotation dryer during alignment of flotation nozzles therein.

These and other objects of the invention will become apparent upon reference to the following detailed description and accompanying drawings.

DETAILED DESCRIPTION OF THE INVENTION

Figure 1:
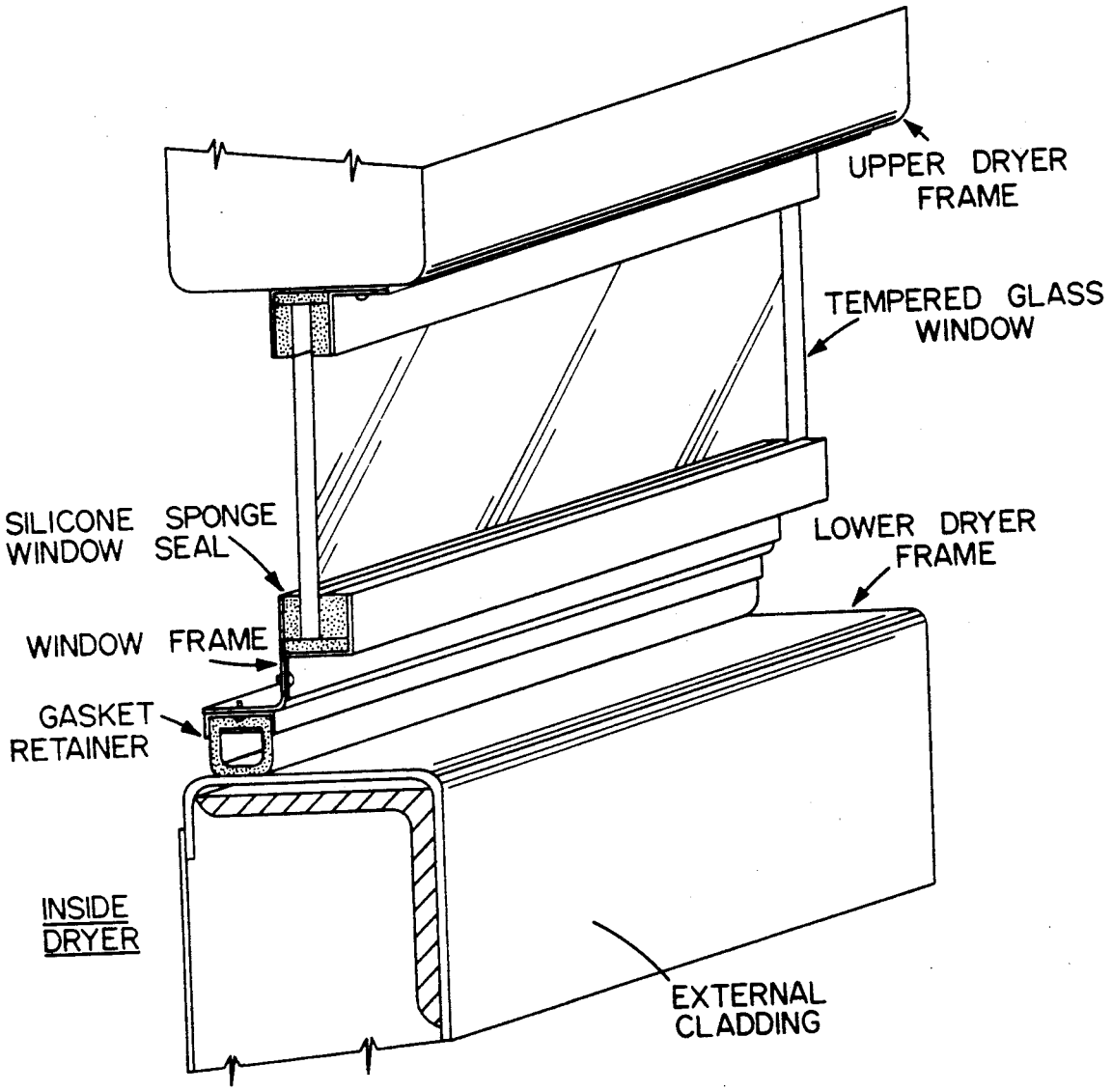
FIG. 1 PRIOR ART
FIG. 1 is a partial view of a prior art seal.
Figure 2:
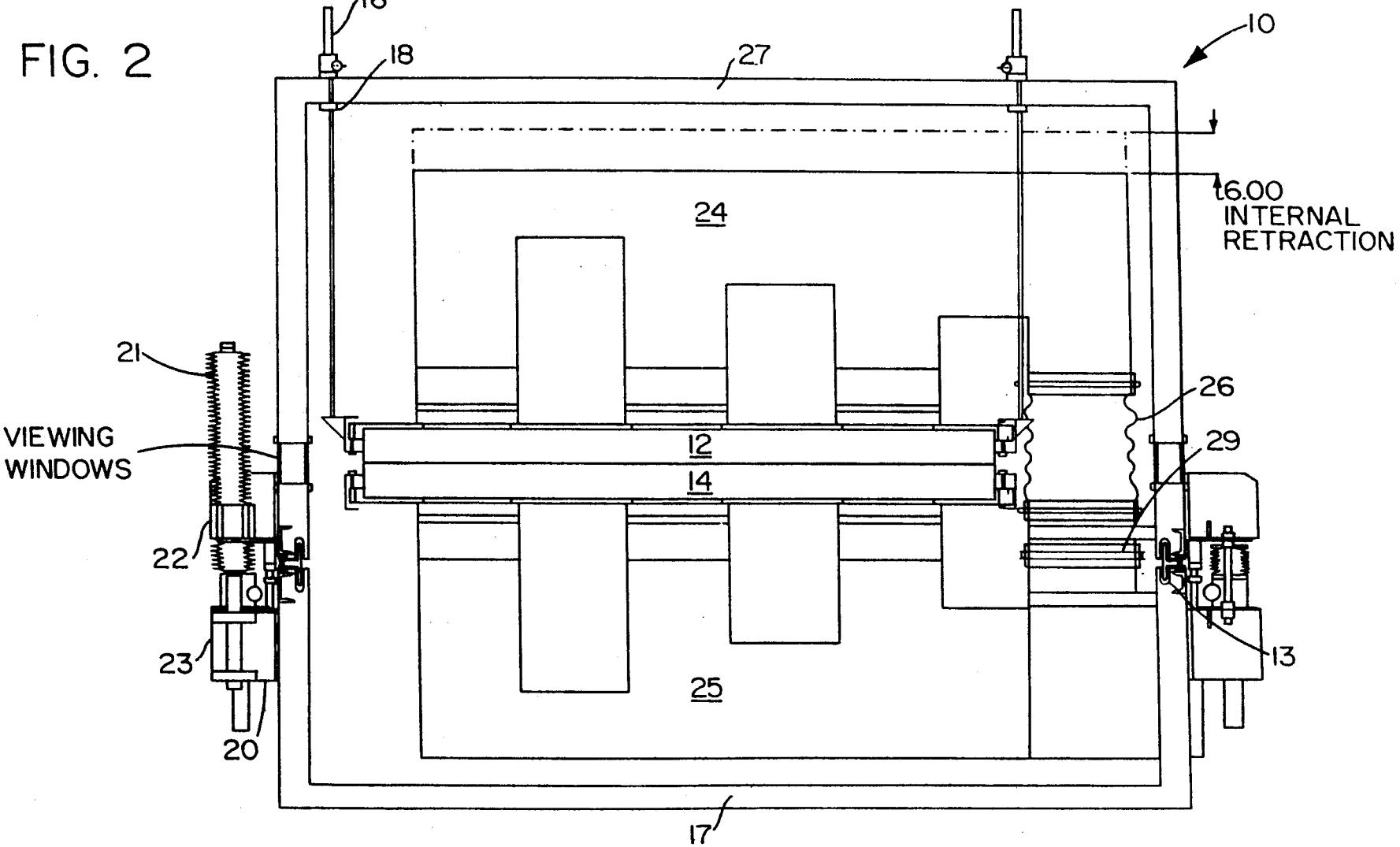
FIG. 2 is a side cross-section view of a flotation dryer having upper and lower flotation nozzle assemblies and a seal in accordance with the present invention; and, FIG. 3 is a view of the seal assembly in accordance with the present invention.

Turning to FIG. 2, a flotation drying enclosure is shown generally at 10. The enclosure 10 houses upper and lower air bar assemblies 12 and 14, respectively. An optional internal retraction system is shown and is comprised of a retraction gear 16 coupled to upper air bar assembly 12 to retract the assembly. This internal retraction allows adjustment of the operating clearance between upper and lower air bar assemblies 12 and 14 over a range of about 6 inches or more. A shaft seal 18 seals the gear 16 in the enclosure 10. Conventional external upper hood retraction gear is shown generally at 20, and includes a linear guide rod cover 21, guide rod bearing 22, and guide rod 23. The retraction system uses mechanical screw jacks that are interconnected by drive shafts. Suitable screw jacks are sold commercially by Duff-Norton ® Company. A retraction drive motor (not shown) drives the screw jack system through two and three way gear boxes. The upper hood can be raised to a maximum of about 18 inches to assist in thread up and maintenance. A hood retraction electronic load control unit (not shown) disengages the hood retraction motor should binding of the hood retraction drive system occur. Upper and lower supply headers are shown at 24,25 and are connected to upper and lower air bar assemblies 12, 14, respectively to allow for gas flow thereto. Internal retraction flex duct 26 compresses upon internal retraction. When the upper hood 27, (which separates from lower hood 17 at separation point 13), supply header 24 and air bar assembly 12 are raised, the duct system disconnects at hood retraction disconnect 29.

An alternate embodiment eliminates the optional internal retraction system and utilizes the external upper hood retraction system to vary the clearance between upper and lower air bar assemblies 12 and 14. The internal retraction flex duct 26 is eliminated and a suitable duct slip connection is employed at hood retraction disconnect 29. Upper hood 27 can be raised or lowered within a range of up to about two inches by the external retraction screwjacks 20 while seal contact is maintained at separation point 13.

Figure 3:
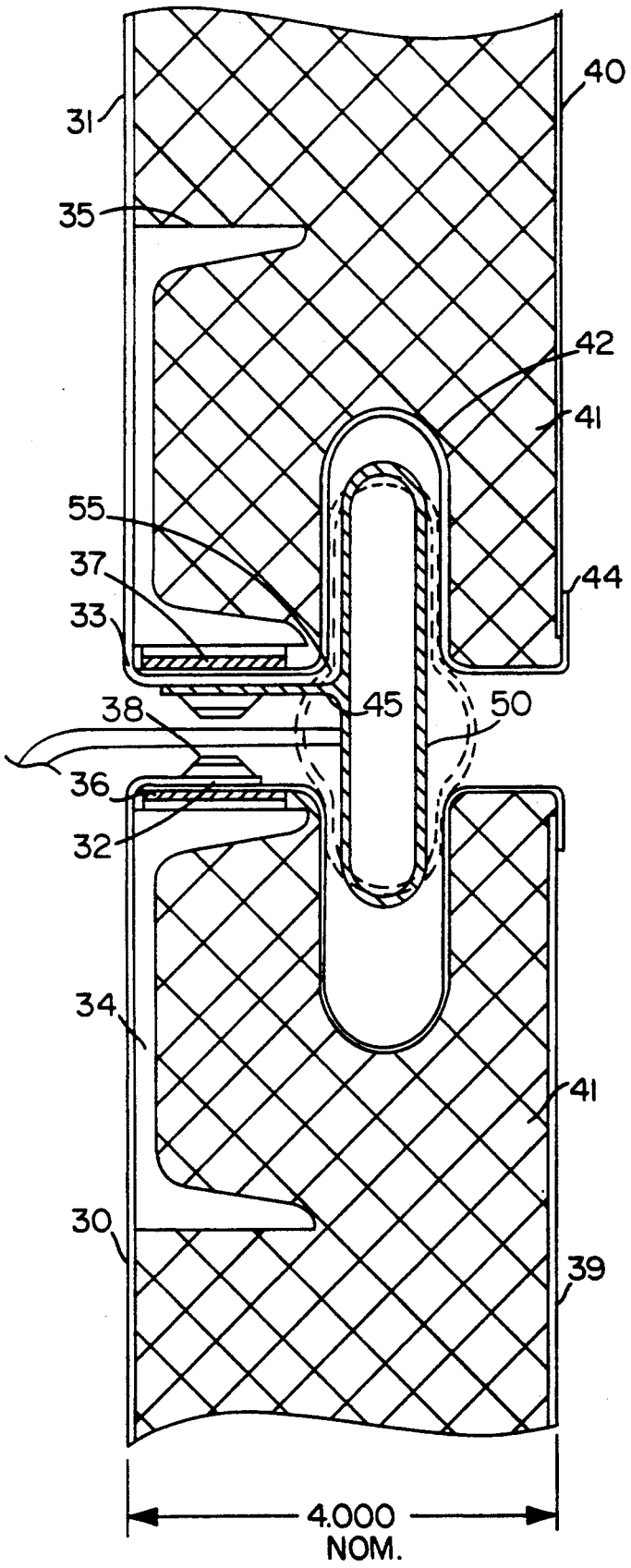

Turning now to FIG. 3, there is shown in detail the seal assembly in upper and lower hoods 27 and 17, respectively. Hood external 12 GA cladding 30 and 31 are shown with flange portions 32 and 33, respectively. Attached to each of the flange portions 32 and 33 are hood frame channels 34, 35. Strips of insulating material 36, 37 may be employed at the attachment points. Attachment can be accomplished by any suitable means, such as with bolts 38. The channels formed by external cladding 30, 31 and internal cladding 39, 40 (14 GA 304 SST) are packed with insulation 41.

Expansion relief bellows 42, 43 are located in the upper hood 27 and lower hood 17 where they terminate at separation point 13, and at the transition from the internal cladding skin 39, 40 of the dryer enclosure to the external cladding 30, 31 and framing. The bellows 42, 43 allow for movement of the internal cladding 39, 40 relative to the external cladding 30, 31 and framing, thereby reducing stresses caused by thermal expansion that would tend to warp or bow said enclosure. The expansion bellows also create a longer (e.g. non-linear) path for heat conduction through the metal connecting the internal skin 39, 40 to the external cladding 30, 31 and framing, thus minimizing thermal expansion and warping. Preferably the bellows are U-shaped as shown, and are made of stainless steel, although mild steel, aluminized steel or other metals can be used depending on the requirements of the dryer internal skin, such as non-corrosive or non-rusting specifications. The leg of each bellows in proximity to the external cladding may be attached thereto by the same means attaching said hood frame channels to the cladding. The leg of each bellows in proximity to the internal skin 39, 40 may have a biased portion 44 that is preferably attached to the internal skin by continuous weld; the use of bolts or the like which penetrate the internal skin is undesirable due to leakage problems.

A seal 50 is positioned to fit into the bellows 42, 43 when the upper and lower hoods are in the closed position. The seal 50 preferably may be of an inflatable type, or of a mechanically resilient material and shape which contacts and conforms to at least a portion of the internal contour of the expansion bellows 42, 43. This method of contact seals the upper enclosure wall to the lower enclosure wall along the perimeter interface on both bellows surfaces, effectively creating a double contact seal. The design allows for movement and misalignment in both horizontal and vertical directions caused by thermal expansion, without loss of seal contact.

Suitable inflatable seals and compression gasket seals are available in molded or extruded forms in materials such as silicone, EPDM, or Viton ®, from commercial vendors such as Presray Corp. In the case of a pressurized inflatable seal, the gasket seal should be deflated through a relief valve prior to moving the hood into the closed position. The seal is then inflated by piping to it a compressed gas source such as air or nitrogen to an operating seal pressure, typically at least about 5 psi and as high as about 100 psi, depending upon exact design parameters and material of the seal. With inflation, the gasket conforms to the bellows seal surfaces.

In the case of a non-inflatable type resilient gasket, an appropriate cross-sectional shape, thickness and durometer is selected for the gasket material to be used giving a pliable yet resilient compression type contact of the gasket to the internal seal surfaces of the bellows area.

One design using an inflatable seal is illustrated in FIG. 3. The leg 45 of seal 50 is affixed to cladding 31 via button head 38. The seal 50 similarly could be affixed to cladding 30, 39 or 40. To mitigate or prevent drooping of the seal after deflation, a retainer strap (not shown) can be used underneath leg 45, for example, to better support the seal, or an adhesive or sealant can be applied such as in corner portion 55 to secure the seal to bellows 42. The seal 50 also can be supported at the internal side of the dryer, although it is preferred that such supporting means not penetrate internal cladding 39 or 40 to avoid leakage problems. The seal 50 is positioned in bellows 42, 43 so that upon inflation, the seal expands and contacts and conforms to at least a portion of the internal contour of bellows 42, 43.

What is claimed is:

1. A dryer enclosure comprising an upper hood and a lower hood, said upper and lower hoods being retractable with respect to each other at at least one separation joint partially defined by bellows having an upper hood portion and a lower hood portion, sealing means comprising a gasket positioned in said separation joint for sealing said separation joint by substantially conforming to the perimeter interface of said bellows upper hood portion and said bellows lower hood portion to form a double contact seal.

2. A dryer according to claim 1 wherein said upper and lower hood each comprise a channel portion defined by internal and external cladding, said upper hood portion being positioned between the upper hood internal and external cladding, and said lower hood portion being positioned between said lower hood and external cladding.

3. A dryer according to claim 2, wherein said upper and lower bellows portions comprise a heat conductive material.

4. A dryer according to claim 3 wherein said upper and lower bellows portions provide a non-linear path for heat transfer between said internal and external cladding.

5. A dryer according to claim 1, wherein the gasket is positioned in said bellows.

6. A dryer according to claim 1, wherein said upper and lower hoods enclose an air bar assembly.

7. A dryer according to claim 1, wherein said gasket is inflatable.

* * * * *